United States Patent [19]

Hughes et al.

[11] 4,122,019

[45] Oct. 24, 1978

[54] METHOD AND APPARATUS FOR CRIMPING SYNTHETIC THERMOPLASTIC FIBERS

[75] Inventors: James K. Hughes, Bartlesville, Okla.; Wayne K. Erickson, Seneca, S.C.

[73] Assignee: Phillips Petroleum Company, Bartlesville, Okla.

[21] Appl. No.: 800,363

[22] Filed: May 25, 1977

Related U.S. Application Data

[62] Division of Ser. No. 607,972, Aug. 26, 1975, which is a division of Ser. No. 319,136, Dec. 29, 1972, Pat. No. 3,911,539.

[51] Int. Cl.[2] ..... D06M 13/46

[52] U.S. Cl. ..... 252/8.8; 8/115.6; 252/8.6

[58] Field of Search ..... 252/8.6, 8.8; 8/115.6

[56] References Cited

U.S. PATENT DOCUMENTS

| | | | |
|---|---|---|---|
| 3,686,025 | 8/1972 | Morton | 252/8.6 |
| 3,743,534 | 7/1972 | Zamora | 252/8.8 |
| 3,862,058 | 1/1975 | Hirschl | 252/8.6 |

OTHER PUBLICATIONS

Rose; The Cond. Chem. Dict. 7th Ed. 1967, Reinhold Publ. Co. p. 870.

*Primary Examiner*—William E. Schulz

[57] ABSTRACT

A finishing agent composition is disclosed made of a major amount of a surface-active material having softening properties for polyolefin fibers, and smaller amounts of a nonionic wetting agent, buffering agent and a corrosion inhibitor, the amounts of the components being such that, when the composition is dispersed in water to provide a dispersion containing from about 1 to about 4 weight percent solids, the dispersion has a pH within the range of 6 to 8.

7 Claims, 10 Drawing Figures

METHOD AND APPARATUS FOR CRIMPING SYNTHETIC THERMOPLASTIC FIBERS

This application is a division of copending application Ser. No. 607,972, filed Aug. 26, 1975, which is a division of application Ser. No. 319,136, filed Dec. 29, 1972, now U.S. Pat. No. 3,911,539, issued Oct. 14, 1975.

The crimping of various synthetic thermoplastic fibers made from materials such as the various polyamides, the various polyesters, and various polyolefins to increase the bulkiness of said fibers is known. Various end uses for various ones of said crimped fibers include uses as carpet yarns, as apparel yarns, in nonwoven fabrics such as carpet backing, and as fiberfill products for filling pillows, furniture upholstering, lining sleeping bags, etc. For example, various bulked nylon yarns are used in carpet yarns and in apparel yarns, various bulked polyolefin fibers are used in nonwoven carpet backings, and various bulked polyesters have been used in fiberfill products. Some of the various bulked synthetic thermoplastic fibers have met with a measure of commercial success in some of said uses. However, others have not. There is, generally speaking, a need for increased bulkiness in all of said bulked fibers. For some of said uses increased bulkiness, and increased permanence of said bulkiness, are necessary for successful use. Generally speaking, the use of polyolefin staple in the manufacture of fiberfill products has met with only very limited success.

The present invention solves the above problems by providing an improved method and an improved apparatus for the crimping or bulking of synthetic thermoplastic fibers. Said method and apparatus are applicable for the production of fiber materials having an increased bulkiness of greater performance from any synthetic thermoplastic fiber which can be crimped to increase the bulkiness thereof. Included among such synthetic thermoplastic fibers are the various polyamides, e.g., nylons; the various polyesters, e.g., polyethylene terephthalate; and the various acrylic fibers, e.g., Orlon. The invention is particularly applicable to preparing fibers having an increased bulkiness of greater permanence from fibers which have been spun from 1-olefin polymers, e.g., polyethylene, polypropylene, copolymers of ethylene and propylene, and others set forth below.

Thus, according to the invention, there is provided a method of crimping synthetic thermoplastic fibers, which method comprises crimping said fibers in the presence of steam by passing same under crimping conditions through a crimping zone comprising a defined first region of low but increasing steam pressure, a defined second region of relatively high steam pressure, and a defined third region of decreasing steam pressure.

Further according to the invention, there is provided apparatus for crimping synthetic thermoplastic fibers in the presence of steam, comprising: a compaction chamber having an upstream end and a downstream end; means for feeding said fibers in the form of a tow or yarn into said upstream end of said compaction chamber into contact with a mass of crimped fibers held compacted therein and cause said introduced fibers to fold and form crimps therein as they contact said mass, and advancing said crimped fibers through said chamber; and means for introducing saturated steam into said chamber adjacent to, but downstream from, said upstream end of said chamber and in a manner to cause substantially uniform distribution of said steam in said mass of fibers and form a defined region of relatively high steam pressure in said chamber.

Still further according to the invention, there is provided a polypropylene fiberfill product comprising short, crimped polypropylene fibers having deposited on the surface thereof a thin coating of a small but effective amount, sufficient to reduce the scroupiness of said fibers, of a finishing agent comprising distearyl dimethyl ammonium chloride.

Still further according to the invention, there is provided a finishing agent composition comprising: on a dry solids basis, from about 86 to about 98 weight percent of a surface-active material having softening properties for polyolefin fibers; from about 0.3 to about 2 weight percent of a nonionic wetting agent; from about 0.7 to about 4 weight percent of a buffering agent; and from about 1 to about 8 weight percent of a corrosion inhibitor; with the amounts of said components being adjusted within said ranges relative to each other so that when said composition is dispersed in water to provide an aqueous dispersion containing from about 1 to about 4 weight percent solids, said dispersion has a pH within the range of from 6 to 8.

As indicated above, the invention is particularly applicable to increasing the bulkiness of fibers spun from 1-olefin polymers, including polypropylene. For this reason, and for convenience, but not necessarily by way of limitation, the invention will be further described with particular reference to polypropylene. Said polymers of 1-olefin which can be used in the practice of the invention are the crystalline polymers and can be made by any of the methods known to the art. Polypropylenes suitable for use in the practice of the present invention include the crystalline homopolymers of propylene and the crystalline copolymers of propylene with at least one other monoolefin containing up to 8 carbon atoms. Generally, the other monoolefins are used in the production of said copolymers in an amount less than about 10 mol percent, preferably in the range of about 1.0 to about 5 mol percent, and more preferably in the range of about 0.1 to about 3 mol percent. Specific examples include fiber-forming homopolymers of propylene, the fiber-forming copolymers of propylene and ethylene, the fiber-forming copolymers of propylene and 1-butene, the fiber-forming copolymers of propylene and 1-hexene, the fiber-forming copolymers of propylene and 1-octene, and admixtures thereof.

The steam used in the crimping operation of the invention can be saturated steam or dry steam, e.g., superheated steam. However, for reasons including cheapness and availability, saturated steam is preferred in most instances.

The invention is described hereinafter with particular reference to crimping operations comprising what is generally known as the stuffer box process. However, the invention is not limited to stuffer box crimping. The method of the invention is applicable to any crimping process which can be carried out in the presence of a hot gas to obtain the advantages of the invention, for example, steam jet crimping employing a suitably designed crimper apparatus which provides in the crimping zone the three regions of steam pressure described herein.

Figure 1:
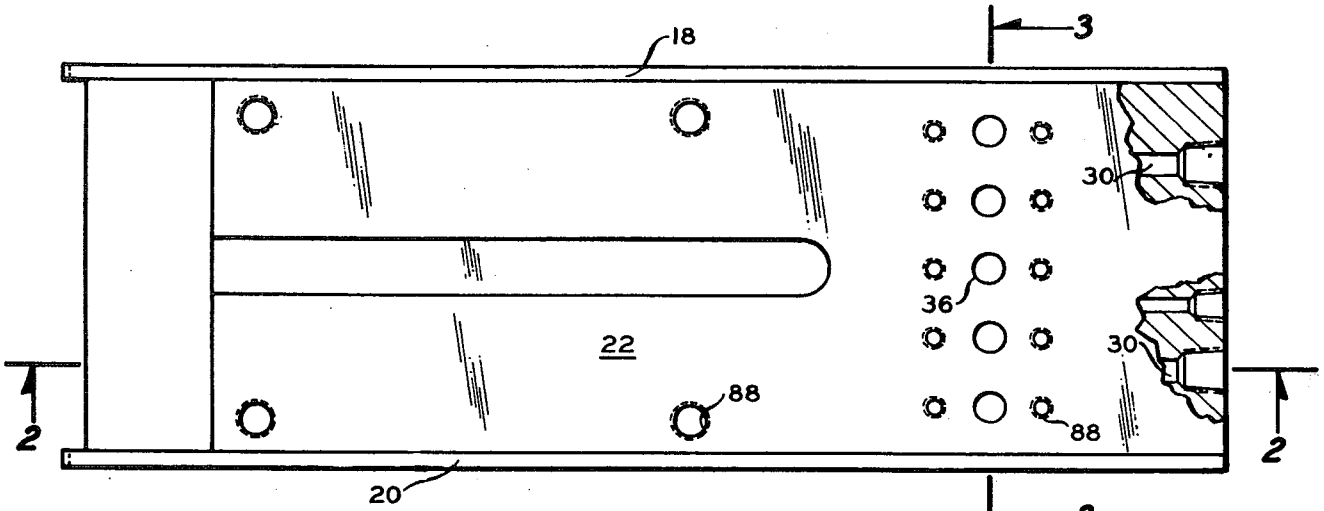
FIG. 1 is a top plan view, partly in section of a crimper apparatus in accordance with the invention.

Referring now to the drawings, wherein like reference numerals are employed to denote like or similar elements, the invention will be more fully explained. In FIGS. 1–5, inclusive, there is illustrated one embodiment of apparatus which can be employed in the practice of the invention. The crimping apparatus illustrated in said drawings is, generally speaking, of the stuffer box type. Said crimper, designated generally by the reference numeral 10, comprises a compaction chamber 12 having an upsteam end and a downstream end. Means are provided for feeding the fibers to be crimped, in the form of a tow or yarn, into the upstream end of said compaction chamber 12 into contact with a mass of crimped fibers held compacted therein, and cause said introduced fibers to bend or fold and form crimps therein as they contact said mass. The feed means illustrated comprises a pair of feed rolls 14 and 16 suitably mounted adjacent the upstream end of said crimper 10, as illustrated. Said feed rolls 14 and 16 can be supported in the positions shown by any conventional means. One or the other of said feed rolls is mounted in conventional manner for vertical movement so as to permit adjustment of the nip or bite therebetween.

Figure 3:
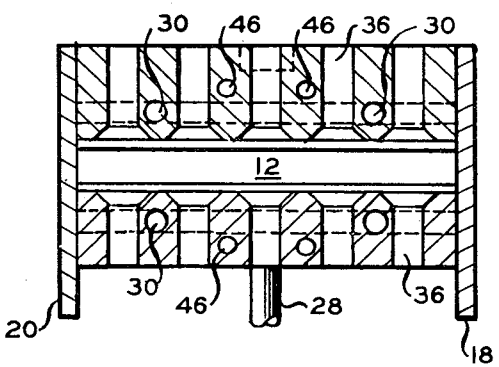
FIG. 3 is a cross section view along the lines 3—3 of FIG. 1.
Figure 4:
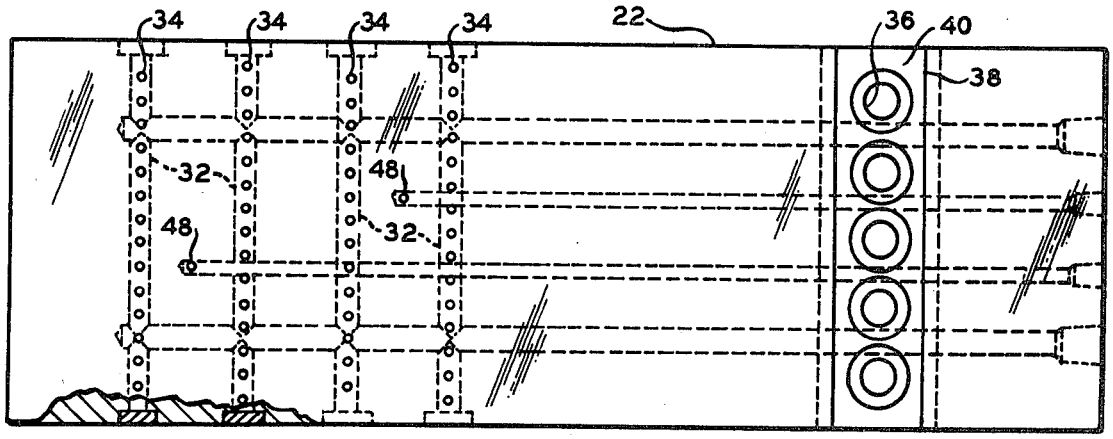
FIG. 4 is a bottom plan view of upper blade 22 of the crimper of FIGS. 1, 2, and 3.

More specifically, said crimper 10 comprises a first generally vertical side member 18 and an oppositely disposed second generally vertical side member 20. An upper blade member 22 is mounted between said side members adjacent the upper edges thereof. A lower blade member 24 is mounted between said side members adjacent the lower edges thereof, preferably spaced above said lower edges a short distance as shown in FIG. 3, and is spaced apart from said upper blade member 22 so as to provide said chamber 12 therebetween. One of said upper and said lower blade members 22 and 24 is movably mounted between said side members 18 and 20 so as to permit varying the height of said chamber, i.e., the space between said blade members. Any suitable means for so mounting said blade members can be employed. Likewise, any suitable means for moving said movable blade member can also be employed. Preferably, the movable blade member will be blade member 24 and will be mounted so as to pivot about the axis of feed roller 16. One means for moving the movable blade member, e.g., said lower blade member 24, can comprise a hydraulic cylinder 26, actuated by air or other fluid, and having push rod 28 connected thereto and also connected to the bottom of lower blade member 24. As will be understood by those skilled in the art, it is desirable to vary the height or space of compaction chamber 12 between said blade members to accommodate the size of tow or yarn being fed into said chamber. It is also desirable to be able to vary said height of said chamber 12 to a greater extent at the downstream end thereof so as to hold a back pressure or compaction pressure on the plug of crimped fibers therein. Any suitable gasket or sealing material (not shown) can be provided between said side walls 18 and 20 and said blade members 22 and 24.

Means are provided for introducing steam into said compaction chamber 12 adjacent to, but downstream from, the upstream end of said chamber and in a manner to cause substantially uniform distribution of said steam in said mass of fibers and form a defined region of relatively high steam pressure in said chamber. Preferably, said steam introduction means will comprise, in each of said blade members 22 and 24, at least one conduit means formed within the blade and communicating with a plurality of passages which in turn communicate with said chamber 12. Said conduit means can comprise at least one longitudinal conduit 30 which extends longitudinally through said blade from its downstream end portion to a point in its upstream end portion. At least one pair of spaced-apart transverse conduits 32 extends transversely across each of said blade members 22 and 24 and intersects said longitudinal conduits 30. A plurality of passages 34 extends from each of said transverse conduits 32 into communication with said chamber 12. In the crimper illustrated in FIGS. 1–4 each of said blade members 22 and 24 is provided with first and second spaced-apart longitudinal conduits 30 and first and second pairs of said spaced-apart transverse conduits 32 which intersect both of said longitudinal conduits 30. A plurality of said passages 34 extends from each of said transverse conduits 32 into communication with said chamber 12.

Figure 5:
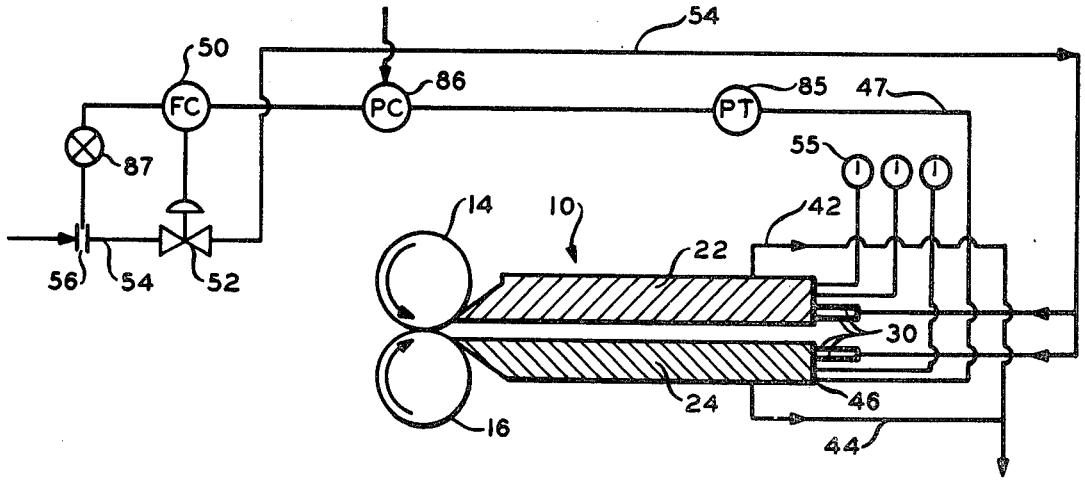
FIG. 5 is a schematic illustration of a flow control system in accordance with the invention.

In the crimper illustrated in FIGS. 1–4, means are provided for withdrawing steam from said chamber 12 at a point upstream from the downstream end thereof. Said steam withdrawal means can comprise a plurality of withdrawal passages 36 in each of said blade members 22 and 24, and which extend through said blade members into communication with said chamber 12. Preferably, each of said withdrawal passages 36 communicates with a recess 38, formed in each of said blade members as shown, and a foraminous plate 40 formed of any suitable porous material, such as sintered metal, is provided in said recesses 38 so as to prevent fibers from entering said withdrawal passages 36. Although not shown specifically in the drawings, it will be understood that each of said withdrawal passages 36 can be connected to a header conduit 42 such as shown in FIG. 5 for upper blade member 22, or a header conduit 44 for lower blade member 24. If desired, a common housing header can be disposed over the withdrawal conduits 36 on each of said blade members 22 and 24, and then said conduits 42 and 44 connected to said housing members.

In accordance with a preferred embodiment of the invention, control means are provided for maintaining a substantially constant steam pressure in a defined region of relatively high steam pressure in chamber 12, i.e., the region in chamber 12 between the most upstream row of passages 34 and the most downstream row of said passages 34, which region of relatively high steam pressure exists in chamber 12 in the practice of the invention. Any suitable control means can be employed for maintaining the steam pressure in said region of relatively high pressure substantially constant. Preferably, this can be accomplished by controlling the rate of introduction of said steam into compaction chamber 12 in accordance with the steam pressure in said region of relatively high steam pressure. One means for accomplishing this is illustrated in FIG. 5. In the crimper illustrated in FIGS. 1–4, each of said blade members 22 and 24 is provided with at least one pressure tap conduit 46 which extends longitudinally through the blade member into communication with a passageway 48 which communicates with said region of relatively high steam pressure in chamber 12. In the crimper illustrated in FIGS. 1–4, each of said blade members 22 and 24 is provided with two of said pressure tap conduits 46. At least one of said pressure tap conduits 46 is operatively connected by means of conduit 47 and a pressure transmitter 85 to pressure controller 86, which in turn is operatively connected to flow controller 50 which controls motor valve 52 in steam conduit 54. The downstream end of said conduit 54 is in turn connected to said pair of longitudinal steam introduction conduits 30 in each of said blade members 22 and 24. In operation, steam flowing through said conduit 54 and orifice 56 therein causes a measurement signal to be transmitted via transmitter 85 to flow controller 50 which is set at a predetermined rate of flow. Said pressure controller 86 is set at a predetermined desired set point in accordance with the pressure it is desired to maintain in said relatively high pressure region in chamber 12. Said pressure controller 86 transmits a control signal to flow controller 50 and resets same in accordance with said signal, and said flow controller 50 then positions valve 52 to control the rate of flow of steam through conduit 54 responsive to the measurement of pressure in said region of relatively high steam pressure in chamber 12. One or more of the other pressure tap conduits 46 can be provided with an indicating pressure gauge 55 as shown.

Figure 2:
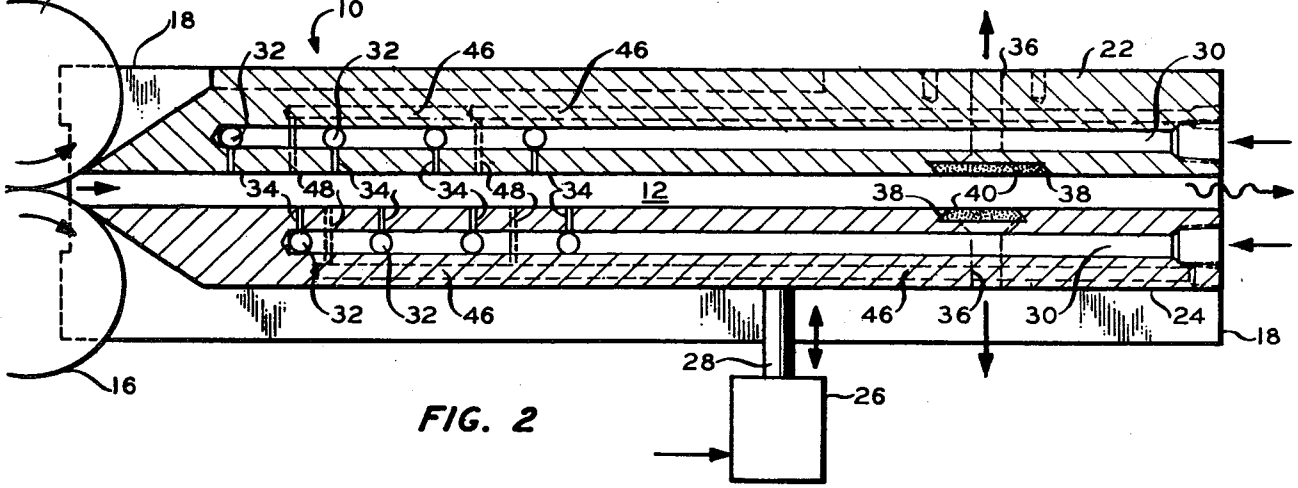
FIG. 2 is a cross section view along the lines 2—2 of FIG. 1.
Figure 6:
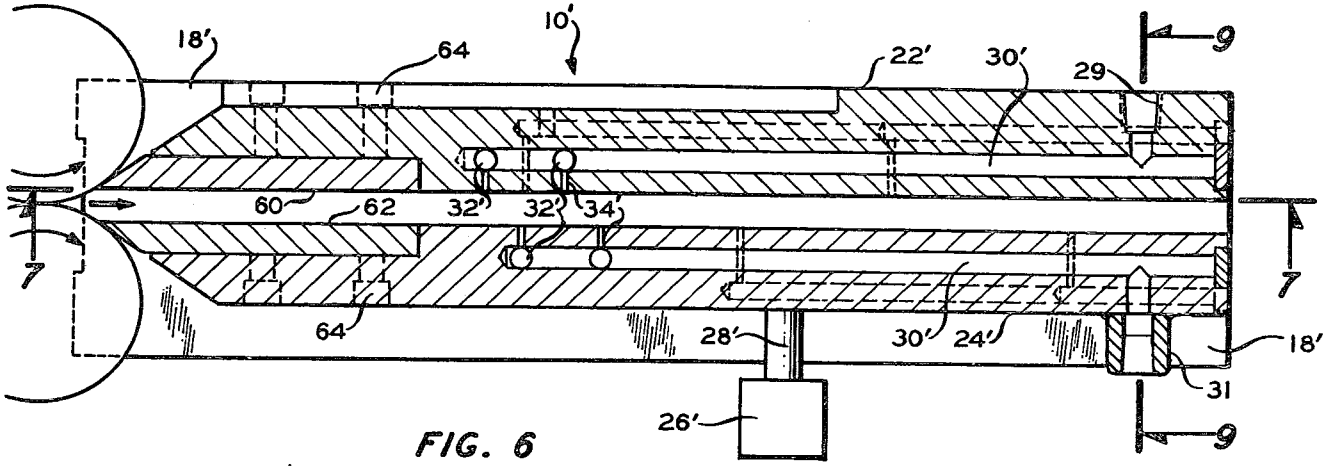
FIG. 6 is a cross section view, similar to FIG. 2, of another crimper apparatus in accordance with the invention.
Figure 7:
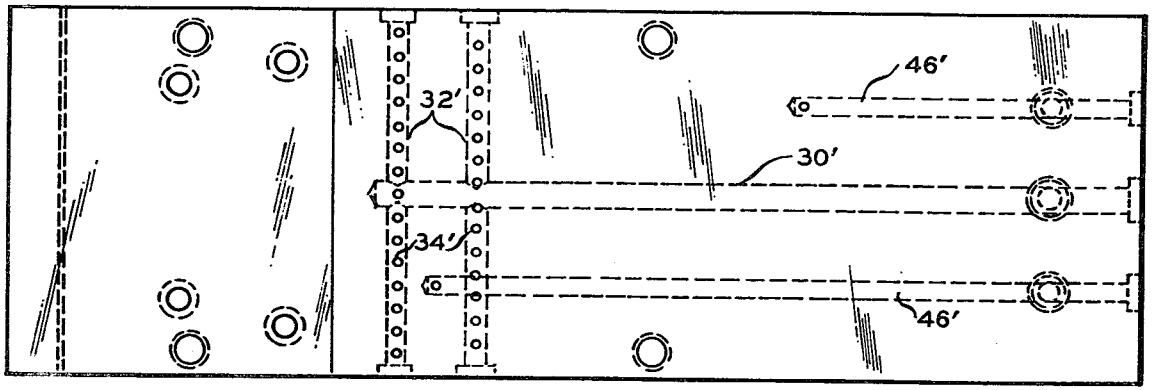
FIG. 7 is a bottom plan view of upper blade member 22' of FIG. 6.

The above-described defined region of low but increasing steam pressure, the defined region of relatively high steam pressure, and the defined region of decreasing steam pressure comprise an important feature of the invention, as discussed further hereinafter. Referring to FIG. 2, said defined first region of low but increasing steam pressure is defined by the upstream end of chamber 12 and the first adjacent row of passages 34. Said defined second region of relatively high steam pressure is defined by the most upstream row of passages 34 and the most downstream row of passages 34. It will be noted that said passages 34 are offset from each other in blade members 22 and 24, thus increasing the effective size of said region of relatively high steam pressure. Said defined third region of decreasing steam pressure is defined by the most downstream row of said passages 34 and the downstream end of said chamber 12. Referring to FIG. 6, said three regions can be similarly defined. The plug of crimped fibers in said defined first region forms a substantial seal but does permit a small amount of steam to escape from the upstream end of chamber 12. Thus, the steam pressure profile increases from the upstream end of chamber 12 toward the first row of passages 34. Similarly, the plug of crimped fibers in said third defined region forms a substantial seal, but there is a decrease in the steam pressure profile between the most downstream row of passages 34 and steam outlet conduits 36.

Referring now to FIGS. 6–9, there is illustrated another crimper apparatus, denoted generally by the numeral 10′, which can also be employed in the practice of the invention. Generally speaking, said crimper 10′ is similar to the previously described crimper 10. One difference is that in said crimper 10′ only one longitudinal steam introduction conduit 30′ is provided in each of blade member 22′ and lower blade member 24′. A pair of spaced-apart transverse conduits 32′ extend transversely across each of said blade members 22′ and 24′ and intersect the longitudinal steam introduction conduit 30′ therein. Said transverse conduits 32′ each communicates with a plurality of passages 34′ which extend from each of said transverse conduits into communication with the chamber 12′, as in said crimper 10 previously described. In upper blade member 22′ and lower blade member 24′, said longitudinal steam conduits 30′ are connected to the steam supply conduit at a point adjacent but upstream from the downstream ends of said blade members by means of passage 29 or coupling 31, respectively, as shown.

In crimper 10′ each of said blade member 22′ and 24′ is provided with a removable tip insert member 60 and 62, respectively, which fit into the recess formed in the upstream end of each of said blade members as shown. Said tip inserts are held in place by means of bolts 64. Said removable tip inserts are provided at the points of greatest wear in said blade members and thus make it possible to replace the worn portion of said blade members without having to replace the entire blade member.

Figure 8:
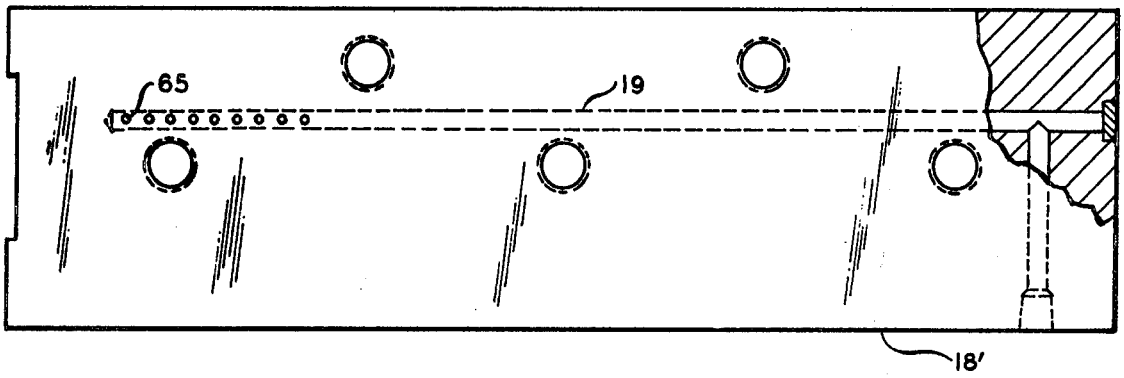
FIG. 8 is a view in elevation of one side member 18' of the crimper illustrated in FIGS. 6 and 7.
Figure 9:
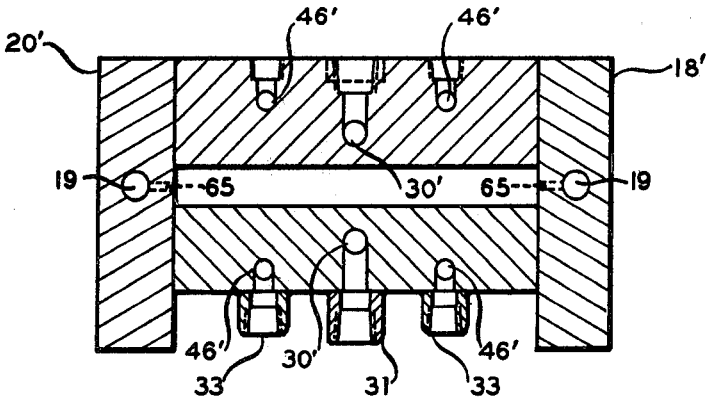
FIG. 9 is a view in cross section along the lines 9—9 of FIG. 6.

Said blade members 22′ and 24′ are mounted between a pair of side plates 18′ and 20′ similarly as described above in connection with FIGS. 1–4 and as illustrated in FIG. 9. Referring to FIG. 8, each of said side plates 18′ and 20′ is provided with a longitudinal steam introduction conduit 19 formed therein and extending from the downstream end portion to a point in the upstream end portion of the side plate. A plurality of passages 65 provide communication between conduit 19 and chamber 12′ for introducing steam into said chamber in the same general region as transverse conduits 32′ and passages 34′ in blade members 22′ and 24′. Said conduit 19 and passages 65 thus aid in providing uniform distribution of steam in the mass of fibers in chamber 12′.

Both crimpers 10 and 10′ can be assembled and mounted in suitable supporting means by means of mounting bolts in bolt holes 88 and other bolts indicated on the drawings.

Figure 10:
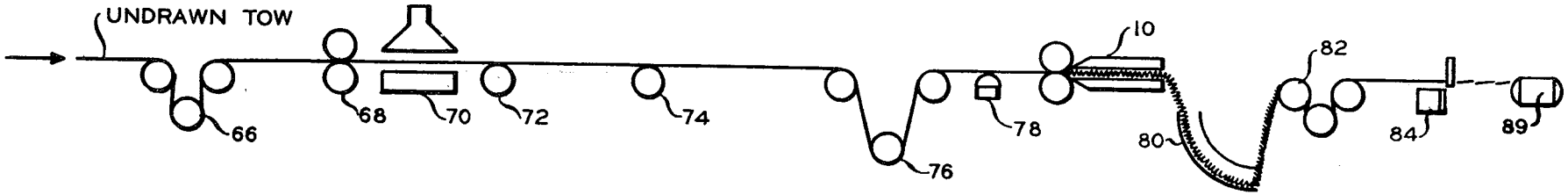
FIG. 10 is a schematic flowsheet of one process embodiment of the invention.

Referring now to FIG. 10, there is illustrated schematically one embodiment of the process of the invention for making staple. It will be understood that the following description of FIG. 10 is by way of illustration only and the various operating conditions set forth in connection therewith are not to be construed as necessarily limiting on the invention. Polypropylene fibers are withdrawn from a suitable creeling apparatus (not shown) to form an undrawn tow of approximately 2,000,000 total denier which is passed through a set of pretensioning rolls 66 at a rate of approximately 41 meters per minute. Said tow is then passed over a first set of heated feed rolls 68 which are heated to a temperature of about 250° F., and at a rate of about 44 meters per minute. The tow is then passed through an oven 70 maintained at a temperature of about 325° F., and then over a set of first stage draw rolls 72 which are heated to about 250° F., at a rate of about 130 meters per minute. The draw ratio between said rolls 68 and 72 is about 2.95X. The tow is then passed over a set of second stage draw rolls 74, preferably not heated in most instances. If desired, said tow can be passed through a suitable shielding means between draw rolls 72 and draw rolls 74 so as to conserve the heat therein. The draw ratio between said rolls 72 and 74 is about 1.15X. The drawn tow is then passed over dancer rolls 76, finish roll 78 or other suitable finish application means, and into the nip of the feed rolls of stuffer crimper 10 or 10', or other suitable crimping apparatus. Preferably, said feed rolls are heated, e.g., about 210° F. As here illustrated, said tow enters the stuffer crimper at a temperature of about 150°–175° F. The feed rolls to the stuffer crimper feed the crimper at a rate of about 135–140 meters per minute. Crimped tow exits from the crimper at a temperature of about 212° F. and falls into J-box 80 which comprises a surge zone. The crimped tow is withdrawn from said J-box at a temperature of about 140° F. by tensioning rolls 82 and passed to staple cutter 84 where it is cut into staple of desired length and then baled in baler 89. If it is not desired to make staple, the cutting and baling operations can be omitted. For example, a plurality of yarns having been processed can be separated into individual yarns after tensioning rolls 82 and then packaged.

The operating conditions employed in the practice of the invention can, in most instances, be varied over relatively wide ranges. Said operating variables are in many instances interrelated and specific values for any particular operating value will, in many instances, depend upon the specific value of one or more other operating variables. For example, the specific values employed in specific instances will depend upon the type of fiber being processed, the fiber denier, the total denier of the tow or yarn being processed, the draw ratio, etc.

The steam pressure employed in the region of relatively high steam pressure in the crimping operation of the invention is an important operating variable. We have found that said steam pressure should be at least about 5 psig (pounds per square inch gauge) in order to obtain a significant increase in crimp recovery over that obtained in the absence of steam. The actual steam pressure employed will depend upon factors such as the type and denier of fiber and the total denier of the tow or yarn being processed. Higher steam pressure can be used with higher denier fibers. For example, higher steam pressures can be used when crimping a 60 dpf polypropylene than when crimping a 10 dpf polypropylene. Excessive steam pressures can disrupt the orderly advance of the fibers through the crimping zone, e.g., by physically blowing the fibers out of the crimper. Thus, to some extent at least, the upper limit on the steam pressure used will be determined by the design of the particular crimper apparatus employed. Thus, in most instances, the steam pressure in said region of relatively high steam pressure will be in the range of from at least 5 psig up to about 30 or 35 psig. For smaller denier fibers, e.g., up to about 18 dpf, said steam pressure should preferably be in the range of at least about 5 psig up to about 20, more preferably up to about 15 psig in some instances. The cross section of the fiber being processed also has an effect on the permissible higher steam pressures. It will be understood that the steam pressure used will be such that the temperature of the steam is sufficient to increase the temperature of the fibers sufficient to soften same and to obtain good crimping, but insufficient to melt said fibers, taking into consideration the residence time of the fibers in the crimper.

The residence time of the fibers in the crimper is not critical so long as it is sufficient to permit the fibers to soften for crimping, but insufficient to cause melting or fusing of the fibers at the highest temperature existing in the crimper. The residence time will vary with the type and denier of the fiber being processed, and also with the mechanical design of the crimper. Thus, in general, no specific numerical upper limits can be set for the residence time of the fibers in the crimper. Generally speaking, and as a guide to those skilled in the art, the total residence time of the fiber in a commercial size crimper similar to those illustrated in the drawings (with a compaction chamber having a width of about 4 inches) can be in the order of from about 4 to about 5.5 seconds. One general rule of thumb which can be followed is that the residence time in said high pressure region should be from about 0.1 to about 0.35 times the total residence time in the crimper.

Maintaining the steam pressure in the region of relatively high steam pressure substantially constant is definitely preferred and is an important operating condition. When using steam a constant, pressure equals a constant temperature. These constant operating conditions result in a markedly more uniform product. We have found that the crimp level, and the crimp recovery, fluctuate much more widely when the steam pressure in the region of relatively high steam pressure in the crimper varies. Steam fills the voids in the mass of crimped fibers. If said voids are filled with steam under essentially constant pressure conditions, this promotes product uniformity. Furthermore, an essentially constant steam pressure in said region of relatively high steam pressure promotes uniformity of conditions in the region of low but increasing steam pressure which is upstream of said region of relatively high steam pressure, because the increase in pressure in said region of low but increasing steam pressure will be more uniform. Similarly, uniformity of conditions in the region of decreasing steam pressure is also obtained because the decrease in pressure therein will be more uniform. This can be shown by running pressure profiles across the three regions present in the crimping zone.

It is not intended to limit the invention by any theories of operation. However, it is presently believed that the improved results obtained in the practice of the invention are due to the following operation of the above-discussed three regions of steam pressure which are provided in the crimping zone. It is presently believed that said defined first region of low but increasing steam pressure functions primarily as a region wherein the temperature is quickly but substantially uniformly increased to the value necessary to obtain good crimping action. A further advantageous function of said first region is the above-discussed sealing action of the plug of crimped fibers in said region. In the absence of elaborate mechanical seals, one cannot have relatively high steam pressures right up to the upstream end chamber 12. Such pressures would force fibers out of said upstream end of chamber 12. Thus, said first defined region of low but increasing steam also serves to simplify crimper design.

It is presently believed that said defined second region of relatively high steam pressure functions primarily as a crimp setting and annealing region wherein, if not already accomplished, said fibers are brought to the temperature of the steam in said second region, and equilibrium is established. Setting and annealing of the crimped fibers is at least initiated.

It is presently believed that said defined third region of decreasing steam pressure serves to continue the annealing of the crimped fibers at a lower temperature level. Thus, said third region serves as a "soaking"

region or slow quenching region, and furthers the setting of the crimp. A further advantageous function of said third region is the above-discussed sealing action of the plug of crimped fibers in said region. In the absence of elaborate mechanical seals, the pressure must be reduced gradually in order to avoid prematurely ejecting the crimped fibers from the crimper. Said third region accomplishes this by, in effect, functioning also as a "sliding seal" for chamber 12. Thus, said third defined region also serves to simplify crimper design.

The overall combined effect or result of the above-discussed three regions of steam pressure is improved crimping action, with the production of a crimped product having increased crimp recovery without employing elaborate crimping apparatus.

The fiber drawing operation employed in the practice of the invention can be carried out in one or more stages in any manner known to the art. Usually, two stages of drawing are preferred with the total draw being divided as desired. Preferably, total draw ratio can be in the range of from 1.5 to 5X, more preferably 3 to 4X.

Crimp frequency can be varied depending upon the type and denier of the fibers being processed. Usually, the crimp frequency will be in the range of from about 5 to about 15, preferably about 8 to about 10, crimps per inch.

When it is desired to produce staple, the crimped fibers can be cut or otherwise made into staple in any manner known to the art. Usually, the staple length will be in the range of from 1.5 to 6 inches. When making a fiberfill product, it is frequently preferred that the staple length be in the range of from about 2 to about 4 inches.

As shown by the examples hereinafter, the invention is applicable to the processing of a wide range of fiber deniers. In terms of drawn denier, the fiber denier can be in the range of from 1.5 to 80, or greater. For some products, e.g., fiberfill products, the drawn denier will preferably be in the range of from about 3 to about 20. The invention is particularly applicable to processing large tows having total deniers (undrawn) of up to 2,000,000 or higher, depending upon the crimper size. The processing of such large tows is made possible because of the three regions of steam pressure which are used in the crimping operation, together with the uniformity of steam pressures and steam distribution, discussed above. The invention is also applicable to the processing of much smaller feeds to the crimper, e.g., a plurality of yarns which some persons might not classify as a tow.

Any suitable finish material known to the art can be applied, in any suitable manner, to the fibers being processed. Usually, the amount of finish applied will be in the range of from 0.1 to 1, preferably 0.2 to 0.6, weight percent based on the weight of the fibers.

We have discovered that fibers comprising crystalline polypropylene and having a denier above about 3 dpf have an undesirable hand, and a high degree of scroopiness (the noise heard when the fibers rub together as when a pillow or an upholstery filling is compressed), when coated with many conventional fiber finish materials. This is particularly undesirable when the fibers are made into staple and the product used as a fiberfill in pillows, upholstery filling, liners for sleeping bags, etc. We have now discovered that polypropylene fiberfill fibers having a very soft nonscroopy hand, low fiber-to-fiber friction, reduced cohesion, and improved processability can be obtained by the application thereto of a surface-active material having softening properties for polypropylene fibers during the spinning and/or drawing steps, and/or also prior to crimping. Said surface-active materials can be applied to said fibers in the amounts set forth above for conventional fiber finishes.

A number of surface-active materials having softening properties for textile fabrics are known. Such materials are commonly quaternary ammonium salts. One group of such materials can be represented by the formula

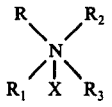

wherein: R and $R_1$ are alkyl radicals containing from 14 to 20 carbon atoms; $R_2$ is a methyl radical; $R_3$ is a methyl, ethyl, or ethoxylated radical $(CH_2—CH_2O)_nH$ where $n$ is an integer of at least one; and X is a chlorine, bromine, sulfate, methosulfate, or ethosulfate anion. See Cohen et al U.S. Pat. No. 3,325,404. Dimethyl difatty quaternary ammonium chloride, in which the fatty group is predominantly a $C_{18}$ saturated group, is commonly used as a textile softener. See Elmquist U.S. Pat. No. 3,377,382. However, it was surprising and unexpected that such materials could be used to soften polypropylene fibers, and particularly surprising and unexpected to discover that such materials could be used to decrease the scroupiness of polypropylene fiberfill fibers.

Presently preferred such materials for use in the practice of the invention include the compounds represented by the above formula, distearyl dimethyl ammonium chloride (Varisoft 100), stearyl dimethyl benzyl ammonium chloride (Varisoft SDC), 1-methyl-1-alkylamidoethyl-2-alkylimidazolinium methosulfate (Varisoft 475); and Varisoft 222, a complex difatty quaternary compound. Excellent results have been obtained when using distearyl dimethyl ammonium chloride, and this compound is a presently more preferred material for use in the practice of the invention, particularly when producing polypropylene fiberfill product.

A number of the above-described surface-active materials have the disadvantage of sometimes being corrosive to some processing machinery. We have discovered that this disadvantage can be overcome, without the expense of employing corrosion-resistant machinery, by the use of a finishing agent composition comprising: on a dry solids basis, from about 86 to about 98 weight percent of a surface-active material having softening properties for polyolefin fibers; from about 0.3 to about 2 weight percent of a nonionic wetting agent; from about 0.7 to about 4 weight percent of a buffering agent; and from about 1 to about 8 weight percent of a corrosion inhibitor; with the amounts of said components being adjusted within said ranges relative to each other so that when said composition is dispersed in water to provide an aqueous dispersion containing from about 1 to about 4 weight percent solids, said dispersion has a pH within the range of from 6 to 8. Any of the above-disclosed surface-active materials having softening properties for polyolefin fibers; any suitable known nonionic wetting agent; any suitable known buffering agent; and any suitable known corrosion inhibitor can be used in preparing said finishing agent composition. A presently preferred composition is obtained when: said surface-active material having softening properties is distearyl dimethyl ammonium chloride; said nonionic wetting agent is a capped polyethoxylated straight chain alcohol; said buffering agent is sodium borate decahydrate; and said corrosion inhibitor is sodium nitrite.

A presently preferred specific fiber finishing agent composition consists essentially of, on a dry basis: about 94.5 weight percent distearyl dimethyl ammonium chloride; about 0.5 weight percent of a capped polyethoxylated straight chain alcohol; about 1.0 weight percent sodium borate decahydrate; and about 4.0 weight percent sodium nitrite. Said finishing agent is preferably applied to said fiber in the form of an aqueous dispersion in an amount sufficient to deposit on the fiber from about 0.1 to about 1.0 weight percent of finish solids, based on the weight of said fibers. It is clear that said distearyl dimethyl ammonium chloride is the sole essential active softening agent in said composition.

As used herein and in the claims, unless otherwise specified, the term "crimp recovery" refers to a measurement which is expressed by the formula $$\% \text{ crimp recovery} = \frac{L_2 - L_3}{L_2} \times 100.$$

Said crimp recovery is determined as follows. A sample of the tow band is taken and values for $L_1$, $L_2$ and $L_3$ are determined. $L_1$ = the length of the tow band after being under a weight of 0.001 gram per denier for one minute. $L_2$ = the length of said tow band after being under a weight of 0.1 gram per denier for eleven minutes. The said tow band is relaxed for three minutes and $L_3$ determined. $L_3$ = the length of said tow band after being under a weight of 0.001 gram per denier for one minute. The values for $L_2$ and $L_3$ are then substituted in the above formula.

As shown by the examples given hereinafter, a marked increase in crimp recovery is obtained in the practice of the invention. It is preferred that fibers crimped in accordance with the invention have a crimp recovery value of at least about 12.5, more preferably at least about 15, percent.

The following examples will serve to further illustrate the invention.

EXAMPLE I

A three melt flow crystalline polypropylene was melt spun using an air quench and in a manner to form a tow of 280 filaments having a total denier of 6,180. Twelve such tows were then plied to form an undrawn tow having a total denier of 74,150. The tow was then drawn 3.75X. A fiber finish having a composition of, on a dry basis, about 94.5 weight percent distearyl dimethyl ammonium chloride, about 0.5 weight percent of a nonionic surface-active agent, i.e., a capped polyethoxylated straight chain alcohol (Rohm & Haas Co. — Triton DF-12), about 1.0 weight percent of sodium borate decahydrate, and about 4.0 weight percent of sodium nitrite, was applied to said drawn tow, in the form of an aqueous dispersion, in an amount sufficient to deposit on the fibers about 0.5 weight percent of finish solids, based on the weight of said fibers.

Said tow was then crimped in a crimper embodying the essential features of the crimper illustrated in FIGS. 1-4 herein. The crimper used had a compaction chamber which was 4½ inches long and a width of ⅝ inch. Saturated steam was introduced into the compaction chamber in a manner in accordance with the invention and so as to establish in said compaction chamber a defined first region of low but increasing steam pressure having a length of about ½ inch, a defined second region of relatively high steam pressure having a length of about ⅞ inch, and a defined third region having a length of about 3 to 3⅛ inches.

Two runs were made. In one run the steam pressure in said second region was 5 psig. In the other run said steam pressure was 16 psig. The denier of the crimped fibers was nominally 7 dpf. The crimp level was 5.5 to 6.5 crimps per inch. Crimp recovery values in the two runs were as follows:

| 5 psig | 16 psig |
|---|---|
| 14.8% | 19.0% |

Generally, polypropylene fibers which have been conventionally crimped in a stuffer box crimper will have a crimp recovery of less than 10 percent. The above values illustrate the marked increase in crimp recovery obtained in the practice of the invention.

Crimped polypropylene fibers processed essentially as described in the above examples have been made into excellent polypropylene fiberfill products. Said fiberfill products can be prepared by cutting the crimped fibers into staple of desired length and carding or garnetting the staple into high loft batts. Bed pillows having excellent high loft and resilience properties have been made.

EXAMPLE II

A 12 melt flow crystalline polypropylene was melt spun using an air quench to form a tow band of 140 filaments having a total denier of 11,000, and then plied to form a tow band having a total denier of 110,000. This tow band was then drawn 5.2X, and crimped as described in Example I above. A conventional finish in the amount of 1 percent by weight, based on the fiber weight, was used. Said finish comprised refined coconut oil and surface-active agents. Three crimping runs were made using saturated steam at 5 psig, 15 psig, and 25 psig. The denier of the crimped fibers was nominally 18 dpf. Crimp recovery values in the three runs were as follows:

| 5 psig | 15 psig | 25 psig |
|---|---|---|
| 13.8% | 15.3% | 18.1% |

The above crimp recovery values illustrate the marked increase in crimp recovery obtained in the practice of the invention, when crimping a higher dpf fiber.

EXAMPLE III

A 12 melt flow crystalline polypropylene was melt spun using an air quench to form a tow band of 126 filaments having a total denier of 10,200, and then plied to form a first tow band having a total denier of 124,000, a second tow band of 184,500 total denier, and a third tow band having a total denier of 204,000. Said first, second, and third tow bands were each drawn 3.83X, and then crimped in the presence of saturated steam as described in Example I. Four runs were made, two at 5 psig steam pressure and two at 12 psig steam pressure. The finish used was the same as in Example II. The fibers in this Example III were trilobal in cross section.

The denier of the crimped fibers was nominally 24 dpf. Crimp recovery values were as follows:

| 5 psig | 5 psig | 12 psig | 12 psig |
|---|---|---|---|
| 124,000 denier | 184,500 denier | 184,500 denier | 204,000 denier |
| 13.9% | 13.6% | 15.9% | 16.8% |

The above crimp recovery values illustrate the marked increase in crimp recovery obtained in the practice of the invention when crimping a still higher dpf fiber having a trilobal cross section.

EXAMPLE IV

A 12 melt flow crystalline polypropylene was melt spun and water quenched to form a tow band of 34 filaments having a total denier of 8,150, which was then plied to form a tow band having a total denier of 100,000. This two band was then drawn 4.8X, and then crimped in the crimper employed in Example I. Three runs were made: one without steam; a second run using saturated steam at 6 psig; and a third run using saturated steam at 14 psig. In said runs using steam the steam was introduced as in Example I. The denier of the crimped fibers was nominally 60 dpf. The fibers in this example were rectangular in cross section. Crimp recovery values were as follows:

| Withuout Steam | 6 psig | 14 psig |
|---|---|---|
| 6.3% | 15.1% | 17.7% |

The above crimp recovery values illustrate the marked increase in crimp recovery obtained in the practice of the invention when crimping a still higher dpf fiber having a rectangular cross section.

Rectangular cross section polypropylene fibers of 60 dpf and the trilobal polypropylene fibers of 24 dpf when crimped in the presence of steam essentially as described in the above Examples III and IV have been found to give excellent results when used to prepare needle punched carpets due to the markedly increased crimp permanence and web cohesion. The crimped fibers produced in accordance with the invention have greatly improved processing performance in cards, garnetts and cross-lapping equipment.

Polypropylene fibers of 18 dpf crimped in the presence of steam essentially as described in the above Example II can be used in the preparation of nonwoven fabrics for carpet backing with good results. Improved web uniformity and reduced fabric shrinkage can be achieved. The crimped fibers will process well in carding, garnetting, and cross-lapping equipment.

The words "tow" and "yarn" are used herein and in the claims, unless otherwise specified, in accordance with the definitions thereof in ASTM D 123-71.

While certain embodiments of the invention have been described for illustrative purposes, the invention is not limited thereto. Various other modifications or embodiments of the invention will be apparent to those skilled in the art in view of this disclosure. Such modifications or embodiments are within the spirit and scope of the disclosure.

We claim:

1. A method for improving the processability of polyolefin fibers in fiber processing equipment comprising applying to said fibers a composition comprising, on a dry solids basis, from about 86 to about 98 weight percent of a surface-active material having softening properties for polyolefin fibers, from about 0.3 to about 2 weight percent of a nonionic wetting agent; from about 0.7 to about 4 weight percent of a buffering agent, and from about 1 to about 8 weight percent of a corrosion inhibitor, with the amounts of said components being adjusted within said ranges relative to each other so that when said composition is dispersed in water to provide an aqueous dispersion containing from about 1 to about 4 weight percent solids, said dispersion has a pH within the range of from 6 to 8, said composition being applied to said fibers in an amount sufficient to improve the processability of said fibers; and passing said treated fibers through said processing equipment.

2. A method in accordance with claim 1 wherein the processing equipment is normally subject to corrosion and the composition is applied in amounts sufficient to reduce corrosion of said equipment.

3. A method in accordance with claim 1 wherein the processing equipment is fiber crimping equipment.

4. A method in accordance with claim 1 wherein the composition is applied to the fibers in amounts sufficient to soften said fibers, reduce the scroopiness of said fibers, reduce the fiber-to-fiber friction and reduce fiber cohesion.

5. A method according to claim 4 wherein said polyolefin fiber comprises crystalline polypropylene, and said surface-active agent having fiber softening properties is represented by the formula

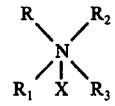

wherein: R and $R_1$ are alkyl radicals containing from 14 to 20 carbon atoms; $R_2$ is a methyl radical; $R_3$ is a methyl, ethyl, or ethoxylated radical $(CH_2—CH_2O)_nH$ where $n$ is an integer of at least 1; and X is a chlorine, bromine, sulfate, methosulfate, or ethosulfate anion.

6. A method according to claim 5 wherein said surface-active agent having fiber softening properties is selected from the group consisting of distearyl dimethyl ammonium chloride, stearyl dimethyl benzyl ammonium chloride and 1-methyl-1-alkylamidoethyl-2-alkylimidazolinium methosulfate.

7. A method according to claim 1 which consists essentially of about 94.5 weight percent distearyl dimethyl ammonium chloride, about 0.5 weight percent of a capped polyethoxylated straight chain alcohol, about 1.0 weight percent sodium borate decahydrate, and about 4.0 weight percent sodium nitrite.

* * * * *

UNITED STATES PATENT AND TRADEMARK OFFICE

CERTIFICATE OF CORRECTION

PATENT NO. : 4,122,019

DATED : October 24, 1978

INVENTOR(S) : James K. Hughes & Wayne K. Erickson

It is certified that error appears in the above-identified patent and that said Letters Patent are hereby corrected as shown below:

Column 14, claim 5, line 34, "according to claim 4" should be

--- according to claim 1 ---.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*